US005605580A

United States Patent [19]

Orita

[11] Patent Number: 5,605,580

[45] Date of Patent: Feb. 25, 1997

[54] CARBURIZATION PROCESS

[75] Inventor: Kazuyuki Orita, Hiroshima, Japan

[73] Assignee: Mazda Motor Corporation, Hiroshima-ken, Japan

[21] Appl. No.: 413,073

[22] Filed: Mar. 29, 1995

[30] Foreign Application Priority Data

Mar. 29, 1994 [JP] Japan ..... 6-084136

[51] Int. Cl.[6] ..... C23C 8/20

[52] U.S. Cl. ..... 148/208; 148/222

[58] Field of Search ..... 148/222, 208

[56] References Cited

U.S. PATENT DOCUMENTS

| | | | |
|---|---|---|---|
| 4,201,600 | 5/1980 | Luiten et al. | 148/208 |
| 4,900,371 | 2/1990 | Dexter et al. | 148/222 |

FOREIGN PATENT DOCUMENTS

| | | | |
|---|---|---|---|
| 59-35630 | 2/1984 | Japan | 148/208 |
| 2-145759 | 6/1990 | Japan . | |
| 403247749 | 11/1991 | Japan | 148/222 |
| 406212396 | 8/1994 | Japan | 148/222 |

*Primary Examiner*—Deborah Yee
*Attorney, Agent, or Firm*—Fish & Richardson P.C.

[57] ABSTRACT

In plasma carburization of the workpiece such as gears, etc., the present invention intends to make the carbon concentration of the carburized layer to be uniform at the edge portion and at the flat portion and also suppress generation of mesh-form carbides along the grain boundary in the edge portion. The workpiece is placed in the vacuum furnace and carburized by feeding carburizing gas into the said vacuum furnace and allowing glow-discharge to take place, and then, continuously, it is decarburized by feeding decarburizing gas such as $CO_2$ gas, etc. It is preferable to repeat carburization and decarburization alternately.

8 Claims, 6 Drawing Sheets

(a) Embodiment:
edge portion
(slowly cooled after carburization)

100 μm (b) Conventional example:
edge portion
(slowly cooled after carburization)

100 μm (a) Conventional example:
flat portion
(hardened after carburization)

25 μm (b) Conventional example:
edge portion
(hardened after carburization)

25 μm (a) Embodiment:
flat portion
(hardened after carburization)

25 μm (b) Embodiment:
edge portion
(hardened after carburization)

25 μm

CARBURIZATION PROCESS

BACKGROUND OF THE INVENTION

1. Field of the Invention

This invention relates to an improvement in carburization process, in particular, plasma carburization process, for forming a carburized layer on the surface of the workpiece with the edge provided (for example, gears).

2. Description of Related Art

Plasma carburization is a process for carburizing the workpiece surface by placing the workpiece in a vacuum furnace, heating it to 850°–1100° C., introducing hydrocarbon gas such as $C_3H_8$ into the furnace as reaction gas, and generating glow discharge to make the workpiece a cathode (for example, Japanese Tokkaihei No. 2-145759) and higher carburization efficiency can be obtained as compared to gas carburization, and has, in general, an advantage that uniform concentration distribution is achieved throughout the whole surface even at a high carbon concentration. After plasma carburization, diffusion treatment is carried out as required to diffuse taken-in carbon inside the workpiece surface and to form a carburized layer with a specified thickness.

Carbon taken into the workpiece surface by plasma carburization gradually diffuses inside during carburization and diffusion followed and the carburized layer of a specified thickness is formed, but when this kind of plasma carburization is applied to the workpiece with an edge portion such as gears, in the carburized layer at the said edges the carbon concentration becomes relatively higher than that at the flat portion. This is attributed to the difference in shapes between the edge portion and the flat portion, and the edge portion A (see FIG. 8) has a small diffusible area inside for the size of its surface area as compared to the flat section B and carbon taken in is difficult to diffuse inside and the carbon concentration on the surface is difficult to lower.

Nonuniformity of surface carbon concentration at the edge portion A and the flat portion B is conspicuous in plasma carburization and it does not create any significant problem in gas carburization. That is, because gas carburization is carburization under the equilibrium state, the carbon concentration on the workpiece surface does not rise beyond the concentration to be equilibrated to the carbon potential in atmosphere and the carburizing speed decreases as the carbon concentration on the workpiece surface increases, and carburization takes place with the surface carbon concentration held nearly constant at the edge portion A and flat portion B. However, because plasma carburization is carburization under the non-equilibrium state and the speed to take in carbon is not so different from that at the flat portion B even if the surface carbon concentration at the edge portion A increases during carburization, the difference on surface carbon concentration after carburization tends to increase. The nonuniformity of carbon concentration is not cleared even if diffusion treatment is carried out.

Consequently, upon completion of diffusion treatment, even if the portion with the carbon concentration exceeding the eutectoid point disappears at the carburized layer of the flat portion B, there is a case in which the portion exceeding the eutectoid point remains at the carburized layer of the edge portion A because the carbon concentration is difficult to lower, and in such event, carbides in the mesh form are formed along the grain boundary at the edge portion A of the workpiece after cooling. The carbides in the mesh form formed along the grain boundary are brittle and workpiece as a crack initiation point (furthermore, the edge portion A is a portion to which stress is concentrated), and once they are formed, they are difficult to disappear even by heat treatment carried out thereafter.

SUMMARY OF THE INVENTION

In view of these problems of conventional plasma carburization, the present invention intends as a first object to form the carburized layer with uniform carbon concentration on the workpiece surface with the edge portion using plasma carburization and as a second object to suppress generation of carbides in the mesh form along the grain boundary at the edge portion.

This invention is to carry out carburization in which a workpiece is placed in a vacuum furnace when a carburized layer is formed on the surface of the workpiece with the edge portion or portions, for example, gears composed of case-hardened steel, carburizing gas is fed into the said vacuum furnace, and glow discharge is allowed to take place, and thereafter to carry out decarburizing treatment to form a carburized layer with uniform carbon concentration on the said workpiece surface. Plasma carburization may be carried out within the temperature range from 850°–1100° C. as conventionally done, and known hydrocarbon gas such as $CH_4$, $C_3H_8$, etc. may be used. On the other hand, the decarburization temperature may be within the temperature range of plasma carburization but it is preferable to use 910° C. or higher to prevent precipitation of ferrite.

As a preferable embodiment of this invention, the process to repeatedly carry out plasma carburization and decarburization alternately can be provided, and as a preferable decarburization means in this prevent invention, plasma decarburization in which decarburizing gas such as $CO_2$, $H_2O$, $H_2$, $O_2$, NOx, etc. is fed into the said vacuum furnace to enable glow charge to take place can be provided. In addition, after plasma carburization or decarburization, diffusion treatment can be carried out as required.

Carbon taken into the workpiece surface during plasma carburization continues diffusing toward inside the workpiece while plasma carburization, but because diffusion is difficult to take place at the edge portion, the surface carbon concentration after plasma carburization becomes higher than that at the flat portion. In the decarburization treatment followed, the carbon concentration decreases while thickness of the carburized layer increases because both diffusion toward the inside and decarburization from the surface take place simultaneously. In this event, it is possible to remove carbon on the edge surface faster than from the flat portion because the edge portion is preferentially carburized during plasma carburization and the fundamentally same shape effect (relatively large surface area at the edge portion) is exerted to increase the decarburization speed at the edge portion. That is, because the edge surface is preferentially decarburized during decarburization, the carbon concentration of the carburized layer is homogenized at the edge portion and the flat portion.

Conventionally, there were cases in which the carbon concentration of the carburized layer of the edge portion did not lower sufficiently even after diffusion treatment and mesh-form carbides precipitated during cooling, but carrying out decarburization after plasma carburization can lower the carbon concentration of the carburized layer at the edge portion in the similar manner as that in the flat portion by the effects of both diffusion and decarburization, and in this way, it is possible to prevent precipitate mesh-form carbides.

In plasma carburization, because the carburizing speed is generally far bigger than the inwards diffusing speed, continuing plasma carburization for a certain long time causes the carbon concentration of the surface layer to rise beyond the eutectoid limit (Acm) at the plasma carburization temperature, possibly generating mesh-form carbides. Because mesh-form carbides are difficult to remove once they are formed as described above, it is necessary to finish up one step of plasma carburization early to suppress the generation.

It would be desirable to take in a required volume of carbon and to obtain a carburized layer with a specified depth and carburization concentration without generating mesh-form carbides by one plasma carburization, but if this is impossible, multiple times of plasma carburization should be carried out with decarburization carried out in between. This can prevent excess carbon from being taken in to the workpiece surface and suppress generation of mesh-form carbides, and homogenization of carbon concentration and inward diffusion by decarburization after plasma carburization are carried out each time, making it possible to obtain a large carburization depth and required carbon concentration for the carburized layer.

In this invention, plasma carburization and decarburization may be carried out continuously in the same vacuum furnace or the two processes may be separated and carried out separately, but in order to prevent precipitation of mesh-form carbides, decarburization shall follow successively plasma carburization without cooling. This is, in particular, convenient when plasma decarburization is carried out, because it can be immediately carried out by only replacing reaction gas in the same vacuum furnace and adjusting glow discharge conditions as required.

It is preferable to keep the plasma carburization temperature to about 850°–1100° C. as conventionally practiced because the carburization speed and diffusion speed increase and carburization efficiency improves as the temperature increases, while excessively high temperature results in poor energy efficiency and increases workpiece distortion. It is also preferable to keep the plasma decarburization temperature over 910° C. to prevent the workpiece surface from being excessively decarburized, even locally, as well as to prevent the portion from being ferritic. Because the diffusion speed is slow in ferrite, once ferrite is generated, it is difficult to get rid of.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein.

THE PREFERRED EMBODIMENTS

Now, embodiments according to the present invention will be described in detail hereinafter together with comparisons. A pinion gear of a differential gear made of case-hardened steel comprising C: 0.18%, Si: 0.09%, Mn: 0.69%, P: 0.006%, S: 0.021%, Cr: 1.02%, Mo: 0.39%, Al: 0.35%, Nb: 0.035%, and the remainder Fe was carburized under the following conditions.

Figure 1:
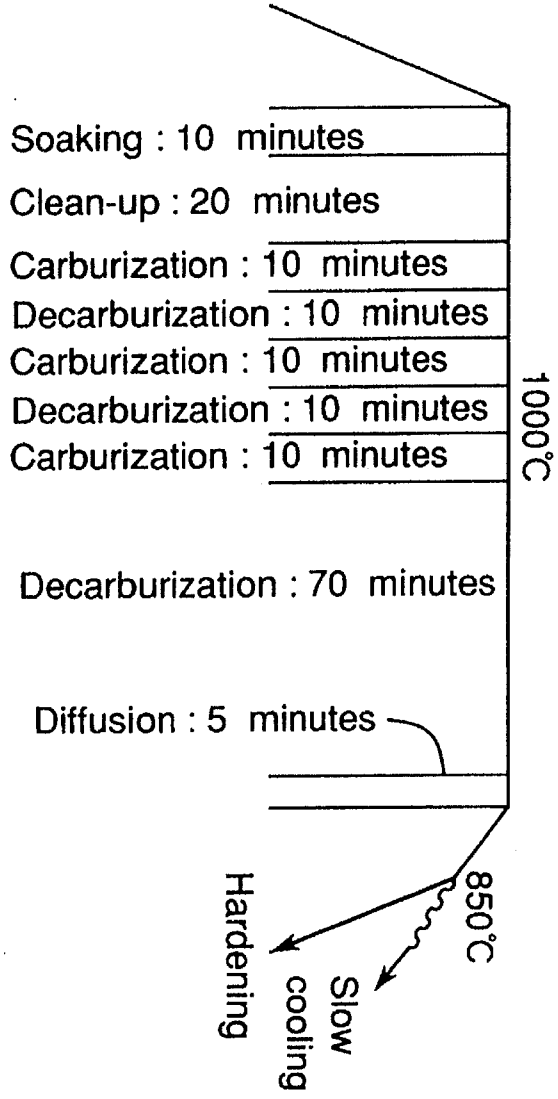
FIG. 1 shows a plasma carburization pattern of the embodiment.

Embodiment (see FIG. 1.)

(1) A workpiece is placed in the vacuum furnace, soaking treatment is carried out at 1000° C. for 10 minutes in vacuum, (2) $H_2$ gas is introduced into the vacuum furnace and the furnace inner pressure is adjusted to 3 Torr, glow discharge was carried out at 350 V and 2 A, and clean-up treatment is carried out for 20 minutes, (3) $H_2$ gas is removed and $C_3H_8$ gas is introduced to adjust the furnace inner pressure to 3.5 Torr, glow discharge is carried out at 400 V, 2 A, and plasma carburization is carried out for 10 minutes, (4) $C_3H_8$ gas is removed and $CO_2$ gas is introduced to adjust the furnace inner pressure to 3 Torr and plasma decarburization is carried out for 10 minutes, (5) plasma carburization for 10 minutes (same conditions as Step (3)), (6) plasma decarburization for 10 minutes (same conditions as step (4)), (7) plasma decarburization for 10 minutes (same conditions as Step (3)), (8) plasma decarburization for 70 minutes (same conditions as Step (4)), (9)the furnace inside is brought to vacuum and diffusion treatment is carried out for 5 minutes, and then, the workpiece is slowly cooled to 850° C. and hardened, or slowly cooled as it is.

Figure 2:
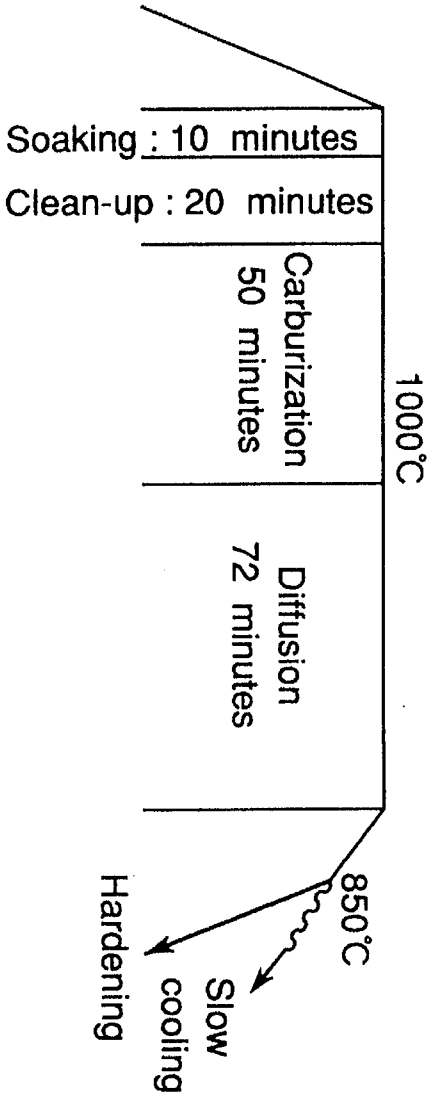
FIG. 2 shows a plasma carburization pattern of the conventional example.

Conventional Example (see FIG. 2)

(1) A workpiece is placed in the vacuum furnace, soaking treatment is carried out at 1000° C. for 10 minutes in vacuum, (2) $H_2$ gas is introduced into the vacuum furnace and the furnace inner pressure is adjusted to 3 Torr, glow discharge was carried out at 350 V and 2 A, and clean-up treatment is carried out for 20 minutes, (3) $H_2$ gas is removed and $C_3H_8$ gas is introduced to adjust the furnace inner pressure to 3.5 Torr, glow discharge is carried out at 400 V, 2 A, and plasma carburization is carried out for 50 minutes, (4) the furnace inside is brought to vacuum and diffusion treatment is carried out for 72 minutes, (5) the workpiece is slowly cooled to 850° C. and hardened, or slowly cooled as it is.

Figure 3:
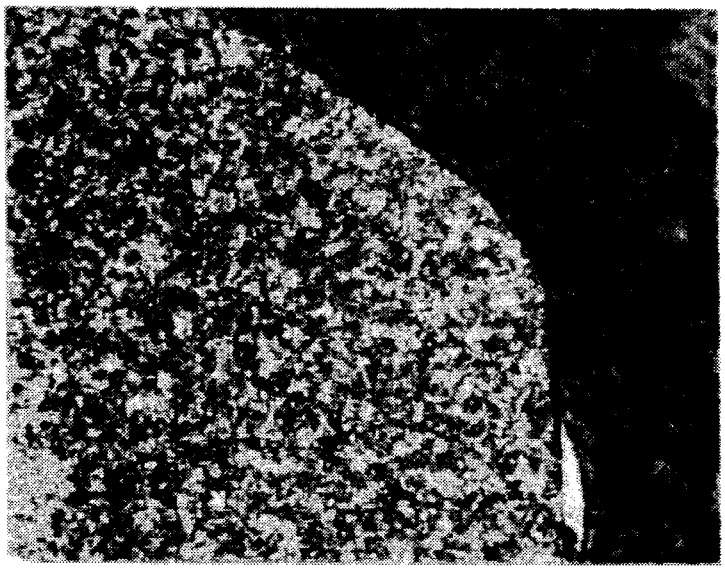
FIG. 3 is a metallographic photomicrograph of the edge portion of the workpiece slowly cooled after carburization, with (a) for the embodiment and (b) for the conventional example.
Figure 3:
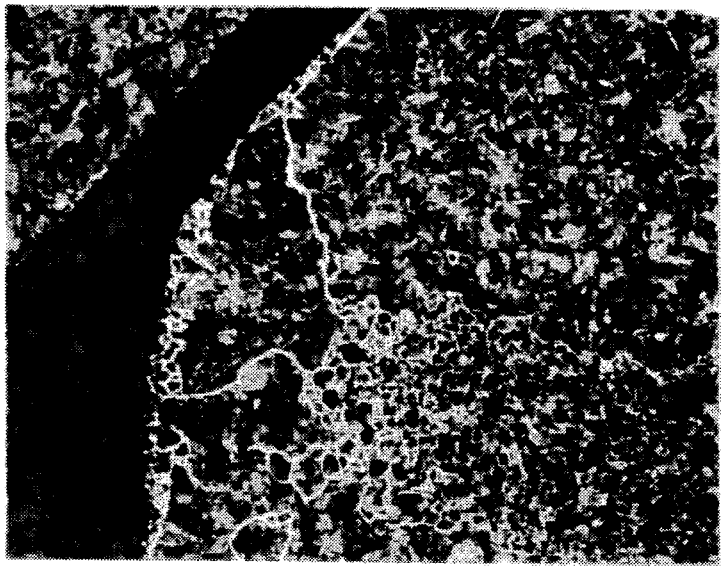
Figure 4:
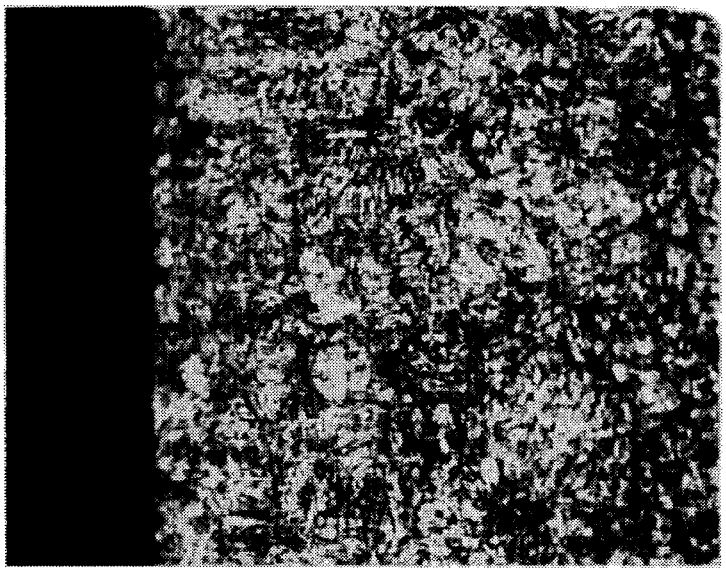
FIG. 4 is a metallographic photomicrograph of the flat portion of the workpiece hardened after carburization (conventional example), with (a) for the flat portion and (b) for the edge portion.
Figure 4:
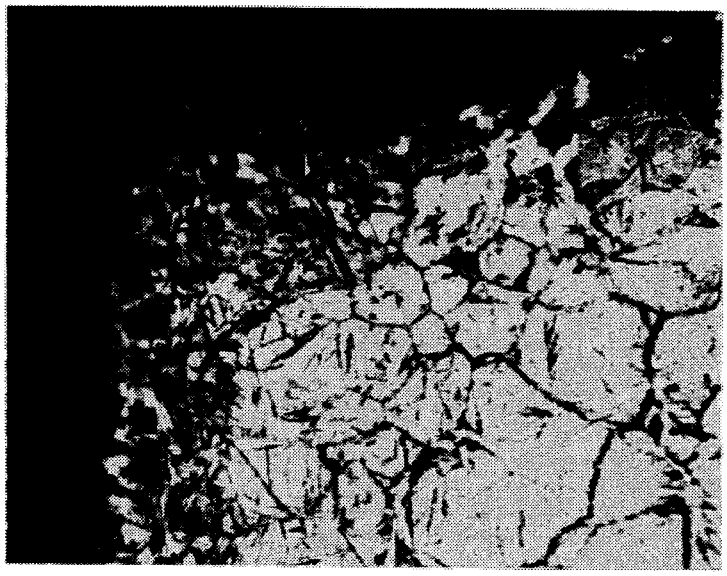
Figure 5:
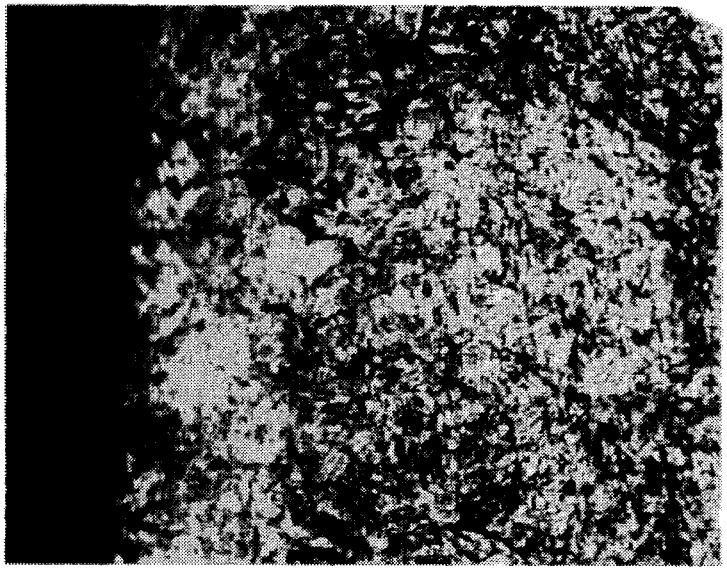
FIG. 5 is a metallographic photomicrograph of the flat portion of the workpiece hardened after carburization (embodiment), with (a) for the flat portion and (b) for the edge portion.
Figure 5:
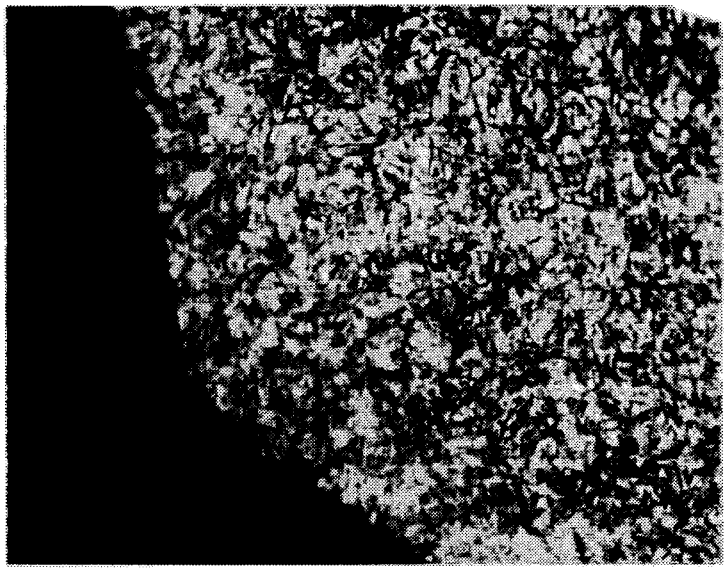
Figure 8:
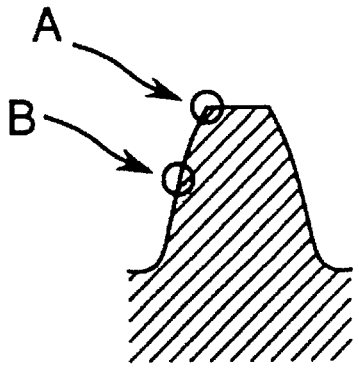
FIG. 8 shows a drawing explaining the edge portion and flat portion.

FIGS. 3 to 5 show metallographic photomicrographs of the edge portion and the flat portion (equivalent to A or B in FIG. 8, respectively) of the specimen slowly cooled after carburized or hardened in this way.

FIG. 3 shows a metallographic photomicrograph of the edge portion of the workpiece slowly cooled after carburization, indicating that carbide precipitates (portion observed in a white mesh-form) along the grain boundary in the pearlite structure in the conventional example (b) but no carbide precipitation is observed in Embodiment (a).

FIGS. 4 and 5 show metallographic photomicrographs of the edge portion and flat portion of the workpiece hardened after carburization in the conventional example and the embodiment, respectively, and in the conventional example of FIG. 4, at the flat portion (a), the marten site structure (shown in black) and residual austenite structure (shown in white) are observed and no carbide is observed, but at the edge portion (b), carbide precipitates in a mesh-form. However, in the embodiment of FIG. 5, no carbide precipitates in either flat portion (a) or the edge portion (b).

Figure 6:
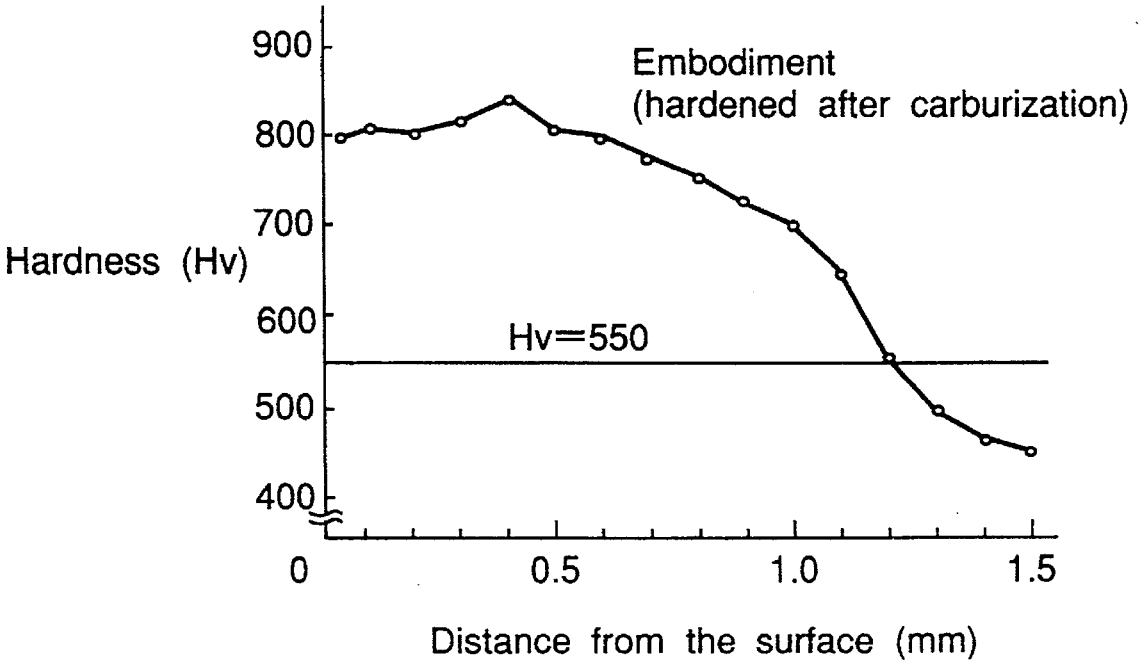
FIG. 6 is a graph showing the relationship between Vickers hardness and distance from the surface in the flat portion of the workpiece hardened after carburization (embodiment).
Figure 7:
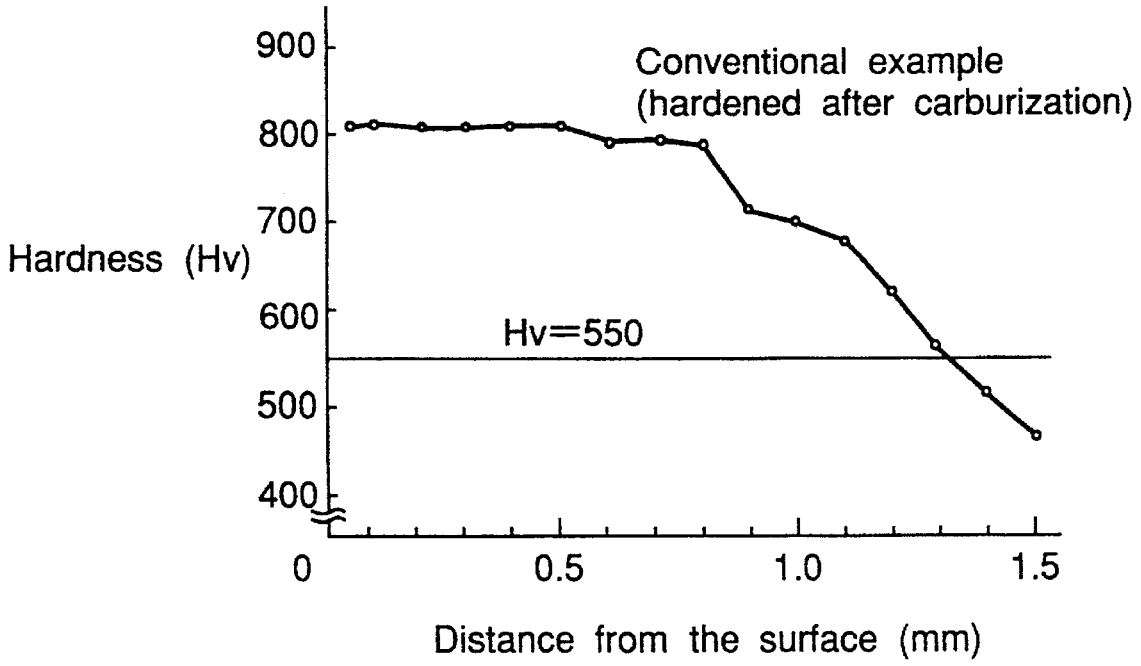
FIG. 7 is a graph showing the relationship between Vickers hardness and distance from the surface in the flat portion of the workpiece hardened after carburization (conventional example).

FIG. 6 shows the relationship between the distance from the surface and hardness (Vickers) at the flat portion in the embodiment in which the workpiece is hardened after carburization and FIG. 7 shows that in the conventional example. In the embodiment, in spite of decarburization being carried out, the surface hardness nearly similar to that in the conventional example is obtained and the 1.22 mm effective hardened layer depth (depth at which 550 Hv or more hardness is obtained) in the embodiment as compared to 1.31 mm in the conventional example, standing comparison with the conventional example.

According to this invention, it is possible to form a carburized layer with the uniform carbon concentration on the workpiece surface provided with an edge portion or portions and it is also possible to prevent mesh-form carbides from being generated at the edge portion at the time of cooling.

What is claimed is:

1. A method for carburizing a surface of workpiece provided with an edge or edges, which comprises steps of:

placing the workpiece in a vacuum furnace, subjecting the workpiece to plasma carburization in which carburizing gas is fed into the said vacuum furnace and glow-discharged, and then subjecting the workpiece to decarburization.

2. A carburization process according to claim 1, wherein plasma carburization and decarburization are repeated alternately.

3. A carburization process according to claim 1 or 2 wherein decarburization is plasma decarburization in which decarburizing gas is fed into the vacuum furnace with the workpiece placed and is glow-discharged.

4. A carburization process according to claim 3 in which the decarburizing gas is $CO_2$ gas.

5. A carburization process according to claim 1, wherein the workpiece is subjected to diffusion treatment after plasma carburization or after decarburization.

6. A carburization process according to claim 2, wherein the workpiece is subjected to diffusion treatment after plasma carburization or after decarburization.

7. A carburization process according to claim 3, wherein the workpiece is subjected to diffusion treatment after plasma carburization or decarburization.

8. A carburization process according to claim 4, wherein the workpiece is subjected to diffusion treatment after plasma carburization or after decarburization.

* * * * *